United States Patent [19]

Sasgen

[11] 4,017,136

[45] Apr. 12, 1977

[54] PERMANENT TRI-HEADED JUMPER CABLE FOR LOCOMOTIVES

[75] Inventor: Peter J. Sasgen, Forest Park, Ill.

[73] Assignee: Power Parts Company, Chicago, Ill.

[22] Filed: Aug. 25, 1975

[21] Appl. No.: 607,559

[52] U.S. Cl. ..... 339/28; 339/10; 339/154 R; 191/11; 280/422

[51] Int. Cl.[2] ..... H01R 33/00

[58] Field of Search ..... 339/10, 15, 16, 28, 339/29, 32, 33, 150, 151, 154; 191/11; 280/422; 213/1.3

[56] References Cited

UNITED STATES PATENTS

| | | | |
|---|---|---|---|
| 615,420 | 12/1898 | Baker | 339/10 |
| 762,684 | 6/1904 | Case | 339/28 |
| 2,693,539 | 11/1954 | Madigan | 280/422 X |
| 3,510,825 | 5/1970 | Quackenbush | 339/29 R |
| 3,660,797 | 5/1972 | Firestone | 339/29 R |
| 3,915,476 | 10/1975 | Burkle | 339/10 X |

*Primary Examiner*—Roy Lake
*Assistant Examiner*—Mark S. Bicks
*Attorney, Agent, or Firm*—Norman Lettvin

[57] ABSTRACT

An improved electrical jumper system, for a locomotive consist for hauling trains, is provided by an installation that converts an existing single-headed receptacle, for receiving one end of a non-permanent jumper cable, into a multiple-headed permanent system that alternatively may be used either to receive a cable head from another locomotive unit, as was the previous purpose of the existing receptacle, or to provide a permanently installed jumper cable that assures presence of equipment at all times to properly electrically connect the units of the consist.

3 Claims, 5 Drawing Figures

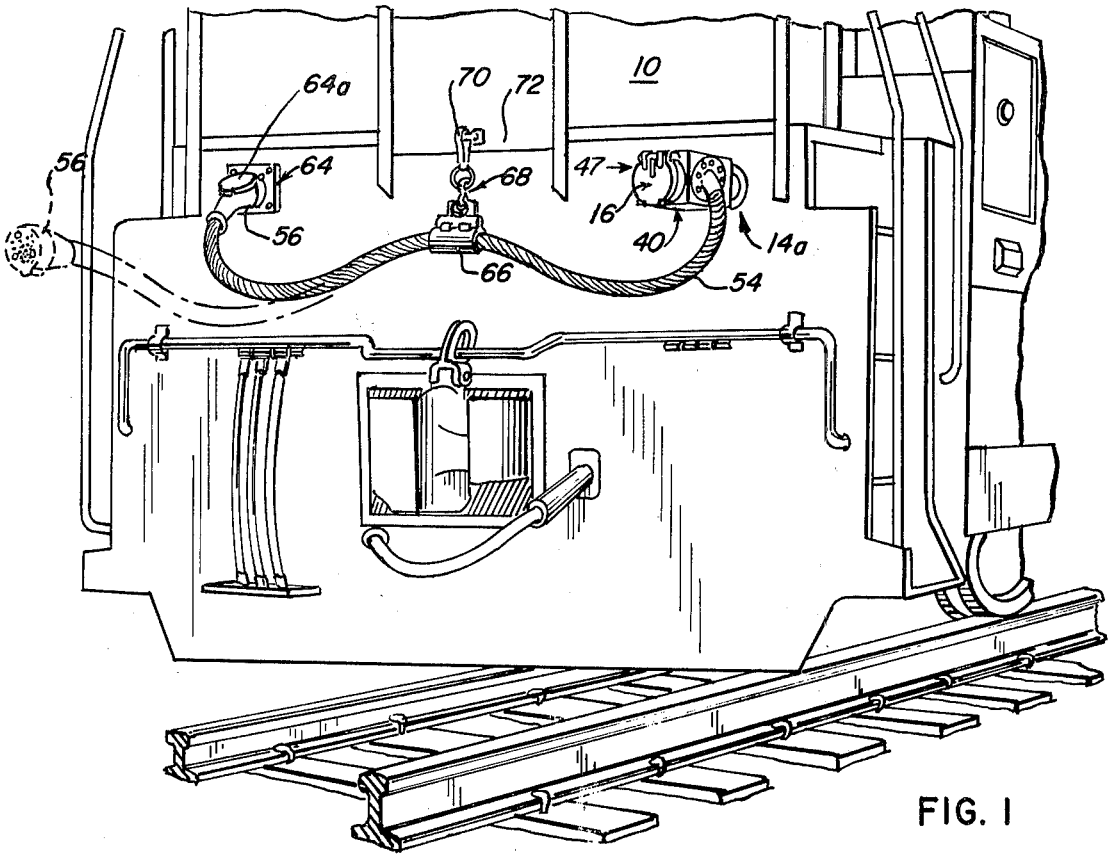
FIG. 1
FIG. 2
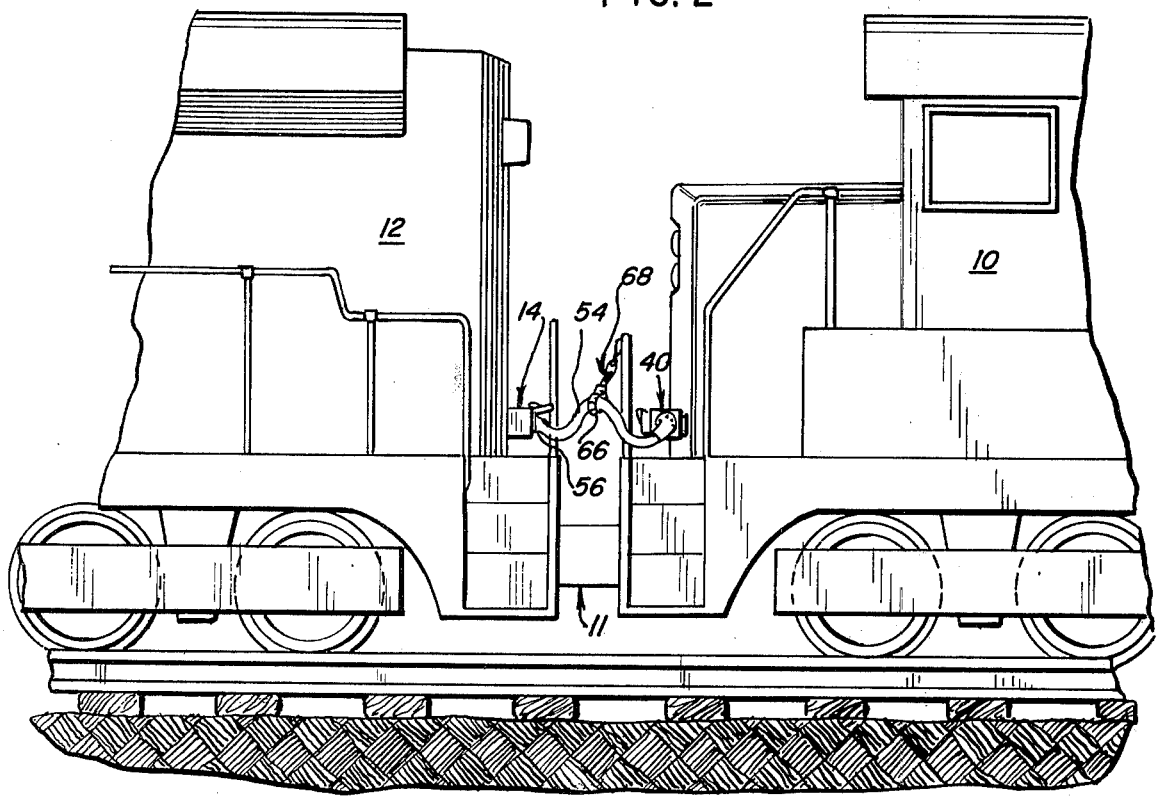

PERMANENT TRI-HEADED JUMPER CABLE FOR LOCOMOTIVES

BACKGROUND OF THE INVENTION

It is normal practice to use two or more locomotive units as part of a "consist" to haul a train. When mulitiple locomotives are used in a consist it is highly desirable that they be electrically interconnected to function properly, so that control circuitry is provided from one locomotive unit, usually the lead unit, through to all other units of the consist so that any electrical action initiated by the controls of the one unit will cause a corresponding reaction in the other units of the consist, thus insuring that all units in the consist perform the same functions at the same time. It is established construction and practice that each locomotive unit is originally provided with an electrical receptacle having multiple pronged terminal contacts, and an elongated jumper cable with headed ends is provided for bridging the space between each pair of locomotive units and for electrically interconnecting the units through the terminal prongs provided in the receptacles.

If, however, a jumper cable is not available, or has been lost or mislaid, and while the units may still be coupled together mechanically through couplers, in order to properly use the consist extra crews may be required to operate the additional units of the consist that are not electrically coupled to the lead unit. It will be readily apparent that unavailability of jumper cables, when needed, results in considerable additional expense of added crew time.

Accordingly, the object of this invention is to modify the existing electrical receptable construction of a locomotive unit and to also provide a permanently mounted jumper cable for locomotive units so that the locomotive units of the consist may be alternatively used either in the same manner as in the past, or by use of the permanently mounted jumper cable that is provided, so that each locomotive unit always has available the capacity to be part of a multiple-unit locomotive consist.

Another object of this invention is to provide, by a simple and relatively inexpensive modification, a permanently mounted jumper cable for a locomotive unit.

These and other objects will become apparent from the following description of the accompanying drawings showing a preferred embodiment of the invention, and by reference to the appended claims.

SUMMARY OF THE INVENTION

Through the invention herein there is provided an improved electrical jumper system for installation on locomotive units, whereby each locomotive unit may be used as part of a consist in the same manner as heretofore, and additionally a permanently mounted jumper cable is available on the locomotive unit to insure that at all times locomotives of a consist may be coupled together, thereby avoilding increased expense when a necessary jumper cable is not available. Advantageously the permanently mounted cable is provided with three connection heads so that one head will secure to the existing connection that is presently used on railway locomotive units, and means are also provided to accommodate the permanently mounted cable in a safe and protected manner.

BRIEF DESCRIPTION OF THE DRAWINGS

FIG. 1 is a fragmentary perspective view of one end of a locomotive unit that has mounted thereon one form of my invention of a permanently mounted jumper cable;

FIG. 2 is a reduced, fragmentary, side-elevational view of adjacent ends of two locomotive units showing the jumper cable used to interconnect the two locomotive units as part of a locomotive consist;

DESCRIPTION OF THE ILLUSTRATIVE EMBODIMENT

Figure 3:
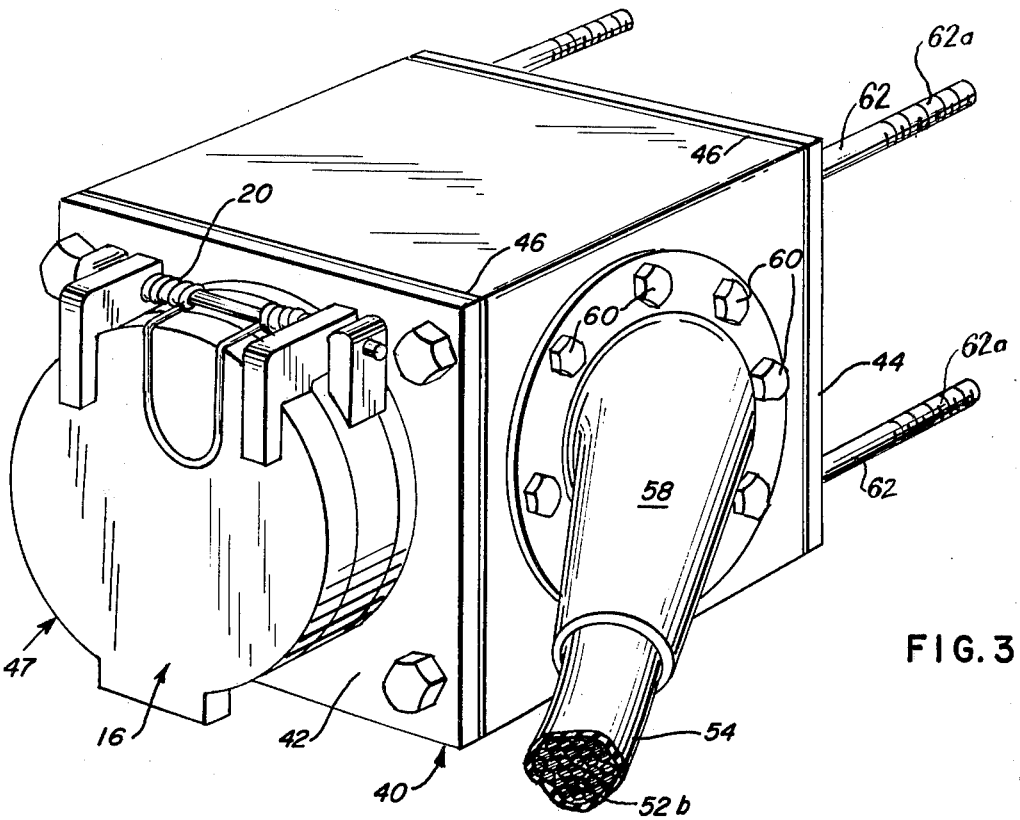
FIG. 3 is an enlarged perspective view of one end of the junction box that serves as part of the invention herein.
Figure 4:
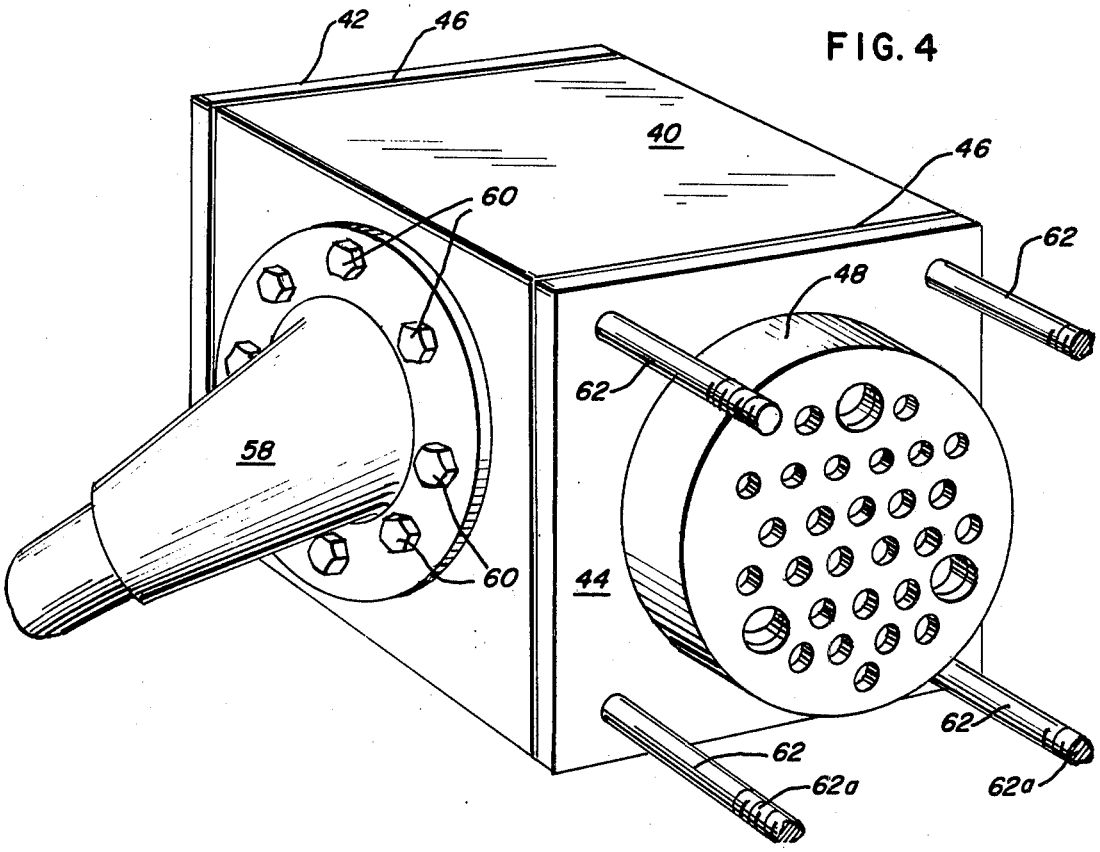
FIG. 4 is a perspective view of the opposite end of the junction box shown in FIG. 3.
Figure 5:
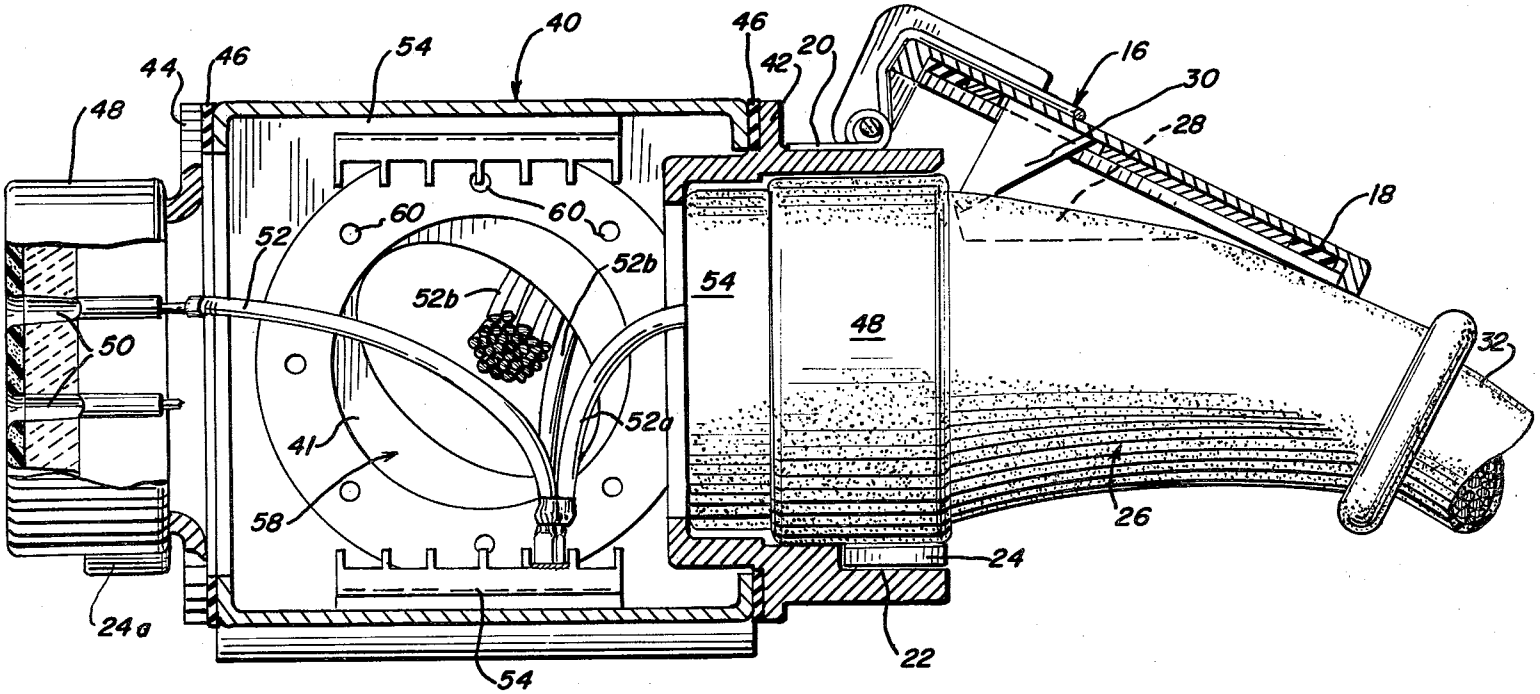
FIG. 5 is a longitudinal cross-sectional view through the junction box shown in FIGS. 3 and 4 illustrating, partially in cross-section and partially in elevation, additional details, including how the female head of a jumper cable is received in the male-pronged receptable provided on the junction box.

Referring now to the drawings, locomotive units, generally 10 and 12 in FIG. 2, and mechanically coupled together as generally indicated at 11, are normally provided with a receptacle located in the region indicated at 14 on locomotive unit 12. Such a receptacle has therein a large number of male pronged electrical contacts to which the female head of a jumper cable, equipped with corresponding female-socketed conductor elements, may be connected. Such receptables are well known in the art and are normally located adjacent one lateral side of the locomotive unit such as at the region indicated at **14*a* in FIG. 1. The usual receptacle is normally provided, as shown in FIG. 5, with a protective cover plate 16 that is gasketed at 18 to effect a seal against entry of moisture, the cover being biased by a spring 20 toward a closed and sealing position. The usual receptacle also has an elongated orientation keyway 22 for cooperation with an enlargement or key 24 formed on a jumper cable head 26 to insure proper alignment and connection, and the head 26 is normally grooved at 28 to cooperatively receive a retaining stud 30 located on the inner side of cover 16 for purpose of preventing inadvertent separation of the jumper cable from the receptacle. The cable 32 that extends between a pair of heads 26 is in effect a tubular sleeve of rubber or the like for protectively housing a plurality of electrical wires that extend between the female-socketed conductor elements in the heads 26** at the ends of the jumper cable. The foregoing is all known in the art and needs no further description, although the features of extant construction are utilized in the invention herein so as to make the improvement compatible with existing equipment.

In the instant invention there is now provided an elongated, hollow, junction box 40 of rectangular cross-section and having attached respectively, front and rear end plates 42 and 44, and side wall means, with appropriate gasketing at 46 between box portions to provide a water-proof housing. Secured to front end plate 42 is a receptacle 47 that encloses a multiple-pronged male electrical connector that is, in effect, a duplicate of the connector in the original receptacle on the locomotive unit. Secured to rear end plate 44 and projecting therefrom is a first mounting stud 48 which, in effect, is a duplicate of the female electrical connector portion of a jumper cable head 26. Stud 48 includes an elongated aligning key 24*a*, and has a plurality of female-socketed conductor elements 50 therein, for connection to the existing male-pronged portion of the original receptacle on the locomotive unit from which the cover has been removed.

Within the junction box 40, each conductor element 50 is electrically connected, such as, for example, by lead 52, to a terminal board, typically 54, where the lead 52 is then electrically connected to a pair of leads 52*a* and 52*b* extending to two corresponding terminals, with lead 52*a* going to a connector, generally 54 equipped with male electrical prongs, so that connector 54 is, in effect, a duplicate of the male-pronged portion of the original receptacle, and lead 52*b* extending through a side aperture 41 in the wall of the side wall means of junction box 40 to pass into and through a permanent jumper cable 54 for connection to a corresponding female-socketed conductor element that is provided as part of jumper cable head 56 seen in FIG. 1. The female-socketed portion of cable head 56 is, in effect, an electrical duplicate of the first mounting stud 48.

The side aperture 41 of box 40 communicates with the central aperture of a tubular mounting 58 to which one end of cable 54 connects. Gasket means, for sealing, are provided between mounting 58 and the apertured side plate of box 40, and screw bolts 60 effect the necessary connections.

The junction box 40 is rigidly secured in position on the locomotive by means of four elongated mounting bolts 62 each of a length to pass through plate 42, the length of box 40, and plate 44, and to extend beyond the rearward projection of stud 48 by end portions 62*a* which are threaded to provide means for attachment into tapped holes provided in the locomotive. In the preferred construction, the mounting bolts of the original receptacle are removed, and elongated bolts 62 utilize the same mounting holes to connect into, holding all the parts assembled and rigidly connected. The force developed by tightening up on bolts 62 secures stud 48 in a water tight connection with the remaining portions of the original receptacle part provided on the locomotive unit, and insures sealing pressures on gaskets 46.

The length of permanent jumper cable 54 is, as seen in FIGS. 1 and 2, selected to be sufficient to bridge the space between two adjacent locomotive units 10 and 12. In order to accommodate the length of cable 54 and to store it safely when not in use, a dummy receptable 64 is provided adjacent the other side of locomotive unit 10 to receive the head 56 at the free end of cable 54. The dummy receptacle has a gasketed cover 64*a*, similar to the cover 16 heretofore described. As further protection, a sling 66 slidably embraces a central portion of cable 54 and in turn is suspended by chain means 68 from a manually releasable hook 70 that fastens to an appropriate connector 72 on the locomotive 10, thereby selectively holding and restraining the central portion of the jumper cable 54 when the cable is not in use.

It will be seen that all wiring is internal and is accomplished within junction box 40, whose interior is accesible through either end or through the side aperture 41.

Although one embodiment of the invention has been shown and described, it is to be understood that various modifications and substitutions may be made by those skilled in the art without departing from the novel spirit and scope of the invention.

What is claimed and desired to be secured by Letters Patent of the United States is:

1. An improved jumper system for use in the electrical interconnection of a pair of locomotive units of a consist for hauling trains, where the end of each locomotive unit adjacent the other locomotive unit is originally provided adjacent one side thereof with a receptacle substantially enclosing a multiple-pronged terminal connector;

said improved jumper system comprising, in combination:

an elongated hollow junction box having opposite ends and side walls means, transverse to the ends, that enclose and surround a space between said opposite ends of the box, and an aperture in said side wall means, a first mounting stud extending from one end of the junction housing and defining therein a plurality of female-socketed elements constructed and arranged for electrical connection to the original multiple-pronged terminal connector on the locomotive, a receptacle at the other end of the junction housing enclosing a second multiple-pronged terminal connector that is a duplicate of the original multiple-pronged terminal connector on the locomotive, the second multiple-pronged terminal connector being electrically connected to said female-socketed elements, an elongated permanently mounted jumper cable originating at one end thereof from the aperture in the side wall means of the junction box and providing at its other end a free head that includes a second mounting stud with electrical connections that are a duplicate of the electrical connections of the first mounting stud at the one end of the junction box, electrical connection means, located within the space enclosed by the junction box and extending through the permanently mounted jumper cable for electrically connecting the female socketed elements of the two mounting studs and the multiple-pronged terminal connector carried on the other end of the junction box, means operatively associated with the junction box for rigidly mounting the junction box on the locomotive with the female socketed elements of the first mounting stud electrically coupled to the multiple prongs of the original terminal connector on the locomotive unit, and a dummy receptacle physically and electrically separated from said first receptacle and mounted on said locomotive unit adjacent the other side thereof, to provide a storage receptacle where the free head of the elongated cable may be selectively entered therein to be held when the jumper cable is not in use.

2. The improved jumper system of claim 1 wherein a central portion of the elongated jumper cable is provided with means for selectively holding and restraining said portion of the jumper cable when the cable is not in use.

3. A system as in claim 1 wherein the junction box is provided with two end plates upon which said first mounting stud and said receptacle are respectively mounted, and a plurality of elongated bolts each of greater length than the junction box extending through both end plates and the junction box and arranged for securement to the locomotive for rigidly mounting the junction box upon the locomotive.

* * * * *